United States Patent [19]

Hoshino

[11] Patent Number: 4,528,888

[45] Date of Patent: Jul. 16, 1985

[54] ADJUSTABLE STAND FOR STEPPED-IN HIGH-HAT CYMBAL

[75] Inventor: Yoshihiro Hoshino, Nagoya, Japan

[73] Assignee: Hoshino Gakki Co., Ltd., Japan

[21] Appl. No.: 505,071

[22] Filed: Jun. 16, 1983

[30] Foreign Application Priority Data

Oct. 28, 1982 [JP] Japan ..... 57-189593

[51] Int. Cl.[3] ..... G10D 13/02

[52] U.S. Cl. ..... 84/421; 84/402; 84/422 R

[58] Field of Search ..... 84/402, 403, 327, 329, 84/421, 422 H, 422 R

[56] References Cited

U.S. PATENT DOCUMENTS 3,742,810 7/1973 Crigger ..... 84/402
4,111,095 9/1978 Simons ..... 84/422 H

FOREIGN PATENT DOCUMENTS 610151 10/1948 United Kingdom .
649914 2/1951 United Kingdom .

*Primary Examiner*—Benjamin R. Fuller
*Attorney, Agent, or Firm*—Ostrolenk, Faber, Gerb & Soffen

[57] ABSTRACT

The cymbals of a high-hat have a closed state where the cymbals are in contact and an open state where the cymbals are separated. For adjusting the pressure of the cymbals in the closed state, an adjusting nut or bolt on a support body moves the holding rod for the top cymbal to adjust the pressure. In an alternate embodiment, a support to which the holding rod is also secured is movable over large distances to move the cymbals between the open and closed states.

9 Claims, 5 Drawing Figures

ADJUSTABLE STAND FOR STEPPED-IN HIGH-HAT CYMBAL

BACKGROUND OF THE INVENTION

The present invention relates to a stand for a high-hat cymbal, where the cymbals are in contact or stepped in and where the pressure of the cymbals against each other is adjustable.

An installation for a percussionist or drummer in an orchestra or musical band includes an array of different drums and cymbals. One of the cymbals may be what is referred to as a high-hat cymbal, comprised of two cymbals which are mounted on a common axis and which are brought together to produce a combined sound. The cymbals of the high-hat either are held separated, are held in contact with each other or are struck together. In the typical high-hat cymbal, one of the cymbals, typically the upper one, is connected with a foot pedal. When the drummer "steps in" the high hat by stepping on the foot pedal, it causes the two cymbals to strike each other. When the cymbals remain together, they are in a closed state. When the pedal is released and is not stepped in, the cymbals are spring-biased apart and are in an open state.

The typical high-hat cymbal has a number of possible ways to function, for producing various sounds. When the high-hat is stepped in, the cymbals contact to produce a crashing sound. While the high-hat cymbals are held in the closed state, they can be beaten with a drumstick, generating a different sound. Finally, with the high-hat cymbals in an open state, the cymbals can be played with a stick, producing yet another sound.

The present invention provides a stand for a high-hat where the cymbals are held in the closed state, so that the cymbals may only be sounded by being played with a stick, and wherein the pressure of the two cymbals against each other may be adjusted.

The invention is directed toward solving a particular problem faced with certain drum installations. The drum installation may include two pedal-operated bass drums, perhaps two sets of tom-toms, a plurality of single cymbals, a tom-tom set sitting on the floor, a snare drum and a pedal-operated high-hat. With two pedal-operated bass drums and a pedal-operated high-hat, there are three pedals to be operated. When both drum pedals are being operated and the musician's feet are occupied, it is not possible for him to step in the high-hat and also not possible to beat the high-hat with a drumstick with the high-hat held in a closed state. Furthermore, the location of the high-hat in the drum installation is restricted because of the requirement that the musician be able to step on its pedal. However, this location has often required the musician to cross his arms so as to reach one drumstick to the high-hat to beat it.

Finally, the pressure of the cymbals of the high-hat against each other in the closed state determines the sound produced by the high-hat in the closed state. It is desirable to be able to tune the high-hat by adjusting the pressure of the cymbals against each other.

SUMMARY OF THE INVENTION

Accordingly, it is the primary object of the invention to provide an effective high-hat cymbal in the closed state.

It is another object of the present invention to provide a high-hat cymbal that is in the closed state, without the musician having to operate a pedal to step in the cymbal.

It is a further object of the invention to enable a musician to adjust the pressure of the high-hat cymbal in the closed state for varying the sound.

It is still a further object of the invention to enable a musician to move a high-hat between its closed and open states without using his foot.

Yet another object of the invention is to provide such a high-hat cymbal which can be comfortably mounted to a support stand for the convenience of the musician.

It is, therefore, the object of the invention to provide a high-hat cymbal which it is possible to beat in the closed state, even if the musician cannot step in the high-hat cymbal to change it to the closed state, where the installation position of the high-hat cymbal is not restricted and where the musical performance of the high-hat cymbal can be varied as desired by the musician.

The high-hat cymbal stand according to a first embodiment of the invention holds the two cymbals of the high-hat permanently in the closed state under adjustable pressure. The bottom cymbal is supported on a support body. That support body, in turn, can be attached to a stand. The top cymbal is attached to a holding rod which passes through the support body. The holding rod is biased to urge the upper cymbal away from the lower cymbal.

A screw and nut mechanism communicates with the holding rod for making fine adjustments in the position of the holding rod with respect to the support body for adjusting the pressure of the two cymbals of the high-hat. In the mechanism, the holding rod has a positioning nut on it which is axially non-shiftable with respect to the support body and which also screw threadedly receives the lower end of the holding rod for preventing the holding rod from moving the cymbals apart under the influence of the biasing means. The holding rod is adjustable along the support body, due to rotation of the stationary positioning nut, to axially position the rod with respect to the support body. This adjusts the pressure of the cymbals of the high-hat in the closed condition. The positioning nut on the holding rod permits very fine adjustments of the position of the holding rod with respect to the body for fine adjustments of the pressure of the cymbals.

In an alternate embodiment, the holding rod has a dual position adjustment means or lever connected with it for selecting between the closed state of the cymbals, which is the permanent condition for the first embodiment, and the open state, with the cymbals initially apart. As this lever can be operated by hand, a pedal is not needed to step in this high hat.

In the closed state of this alternate embodiment, for obtaining fine adjustments of the pressure of the cymbals, fine movements of the holding rod are also made, as in the first embodiment. However, in this embodiment, an adjusting bolt replaces the adjusting nut. That adjusting bolt is screw threadedly supported at the bottom end of the support body and that bolt is rotated with respect to the body for moving the bolt axially with respect to the support body. The holding rod is connected with the bolt to shift axially with it, without also rotating with the bolt. The rotation of the bolt thus adjusts the holding rod along the support body, as in the first embodiment, for adjusting the pressure of the cymbals.

Other objects and features of the present invention will become apparent from the following description of two preferred embodiments of the invention, considered in conjunction with the accompanying drawings.

DESCRIPTION OF THE PREFERRED EMBODIMENTS

Figure 1:
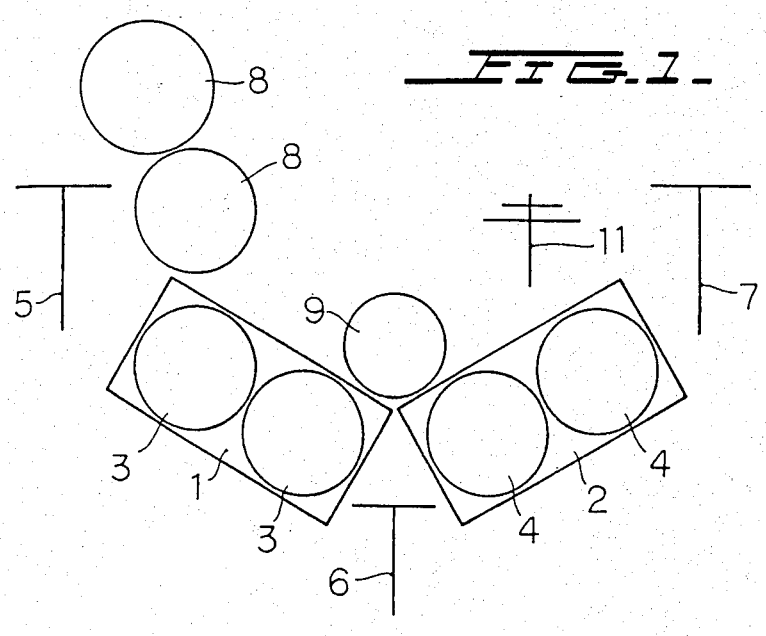
FIG. 1 diagrammatically represents an arrangement of drums and cymbals for the percussion section of an orchestra.

FIG. 1 shows a typical array of drums and cymbals around a musician. It is a twin-bass system including two bass drums 1 and 2 (which are stood upright so that their peripheries are visible), two sets of tom-tom drums 3 and 4, three single cymbals 5, 6 and 7, a set of floor tom-toms 8 on a stand on the floor, a snare drum 9 and a high-hat cymbal 11. There are two foot pedals (not shown) for the bass drum, whose operation would require both of the musician's feet. This would make it impossible for the musician to also step in the high-hat cymbal to hold it in the closed state so that it could be played with a drumstick. In addition, the position of the high-hat cymbal in the array in front of the musician is restricted because of the need that he be able to reach the high-hat cymbal pedal. This has sometimes required the musician to cross his arms in order to be able to strike the high-hat cymbal and another drum or cymbal at the same time.

Figure 2:
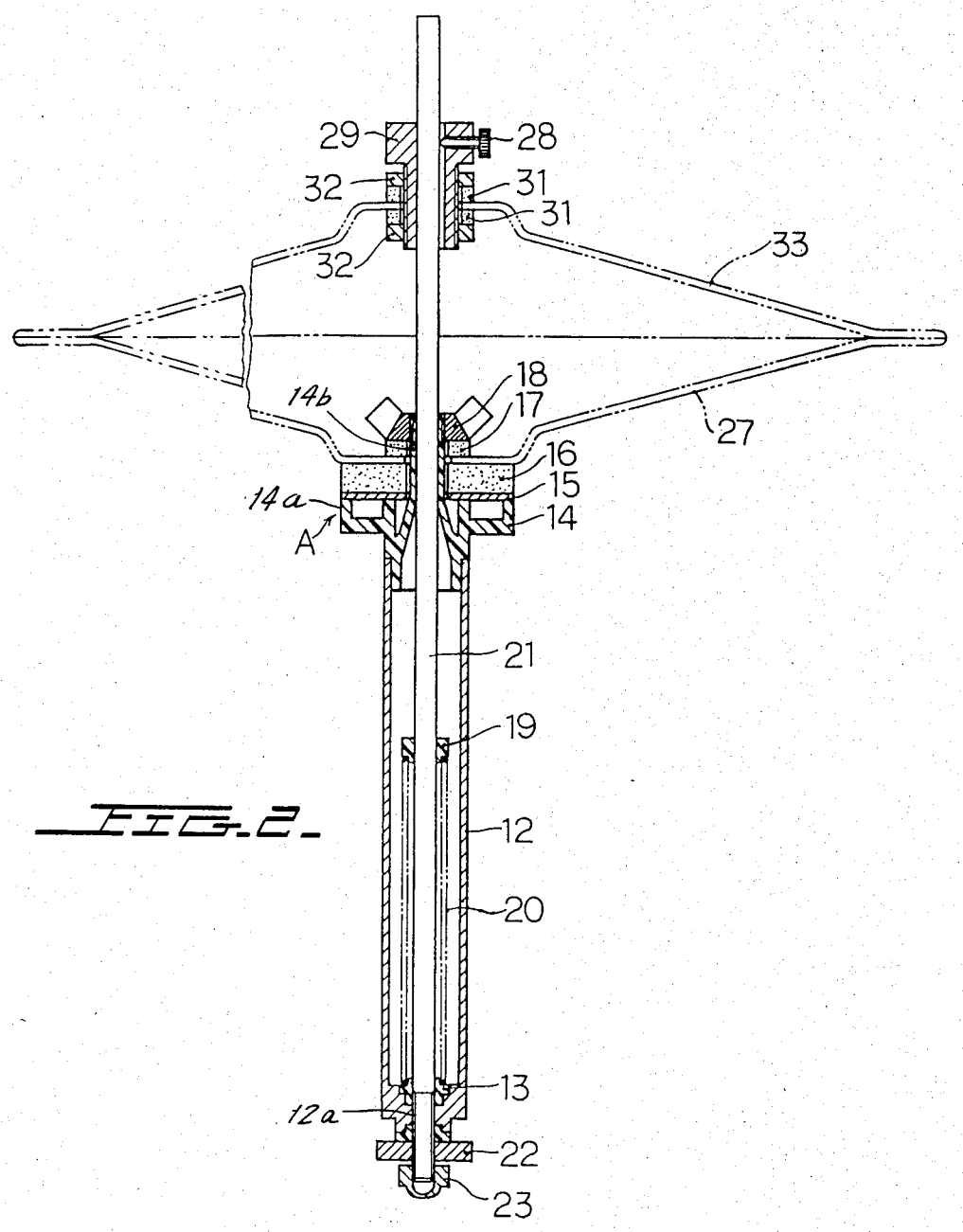
FIG. 2 is a vertical cross-sectional view through a first embodiment of a high-hat cymbal and stand according to the invention.

FIG. 2 shows a first embodiment of the invention. It includes a hollow, rigid stand pipe or support body 12. The holding part A for the bottom cymbal 27 is defined at the top of the pipe 12. The bottom of the pipe 12 has a hole 12*a* through it for passage of the holding rod. On the inside of the bottom of the pipe, there is a seat 13 for receiving a spring or other elastic body or biasing means, which seat is defined by a bushing of synthetic resin material.

The holding part A for the bottom cymbal is comprised of a base portion 14 of a synthetic resin which is supported on and extends down into the upper end of the pipe or support body 12. There is a widened support flange portion 14*a*. Projecting up from the center of the base 14 is an upwardly protruding portion 14*b*, which is open internally for freely slidably receiving the below-described top cymbal holding rod 21 and which is externally screw threaded for receiving the lock nut 18. Atop the wide portion of the base 14 and around the upwardly protruding portion 14*b* is positioned an annular metal ring 15. A larger diameter, thicker, annular felt ring 16 is disposed atop the metal ring 15 and around the portion 14*b*. The bottom cymbal 27 has a central opening through it and it is placed over the felt ring 16. Then another, smaller diameter, annular felt ring 17 is placed above the cymbal 27. Finally, a wing nut 18 is screwed onto the screw threaded exterior of the protruding portion and is tightened down against the felt ring 17, thereby to securely hold the bottom cymbal 27 in place on the base 14.

There is a holding rod 21 for the top cymbal 33. That rod extends upward from beneath the bottom end of the stand pipe or support body 12, through the hollow of the pipe 12, and through the central opening in the lower cymbal base 14. The opening 12*a* through the bottom end of the stand pipe 12 and the opening through the base 14 are narrow enough to laterally guide the rod 21 and are wide and smooth enough to permit the rod free axial movement with respect to the stand pipe 12. A seat element 19 is fixed on the rod 21 inside the stand pipe 12 for serving as the other seat for the elastic body, the compressed coil spring 20. The spring 20 extends between the spring receiving seat 13 below and the spring holding seat 19 above, and the spring 20 normally urges the rod 21 upwardly. By means described below, this helps to precisely position the upper cymbal 33. Any other biasing means or elastic body, such as an elongate, annular rubber tube might be used in place of the spring 20.

The lower part of the holding rod 21 is externally screw threaded. The portion of the rod 21 extending beneath the lower end of the stand pipe 12 has an adjusting nut 22 screwed on it which bears against the bottom end of the stand pipe 12 due to the constant upward bias of the spring 20 upon the holding rod 21. The end nut 23 at the bottom end of the rod 21 serves as an ornament and prevents the adjusting nut 22 from being turned sufficiently to be removed from the bottom end of the rod 21.

The top cymbal 33 is fixed to the upper end of the holding rod 21. For this purpose, a tubular bolt 29 with a passage opening through it is received on the rod 21 and is secured at a fixed position along the rod 21 by the set screw 28 across the bolt. The externally threaded bottom projecting shank of the bolt 29 has a bottom nut 32 screw threaded onto it. An annular felt ring 31 is disposed over the shank of the bolt 29. The cymbal 33 has a hole through its center through which the bolt 29 extends and the cymbal seats atop the bottom ring 31. An upper felt ring 31 is disposed above the cymbal 33, and a nut 32 is fixed above the felt ring 31. When the two nuts 32 are tightened toward each other, the upper cymbal 33 is fixed in position with respect to the bolt 29. With the bolt 29 fixed in position along the rod 21 by the set screw 28, the cymbal 33 is fixed on the rod. The cymbal 33 is set in position with respect to the cymbal 27 that they are in the closed state illustrated.

Figure 3:
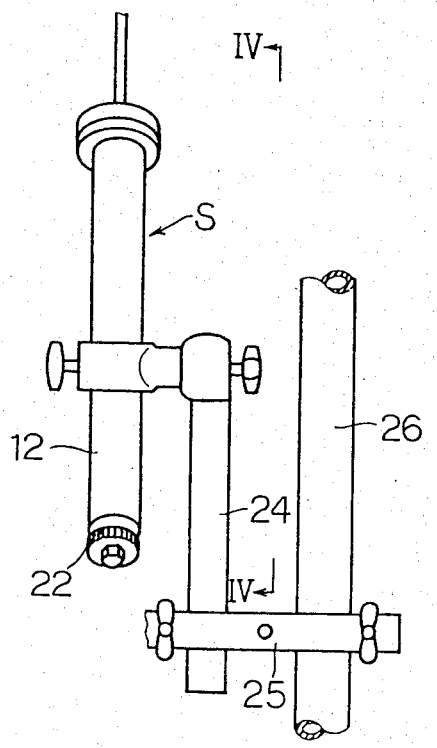
FIG. 3 is a front view showing one manner of installation of the high-hat stand of FIG. 2 to a drum stand or support.
Figure 4:
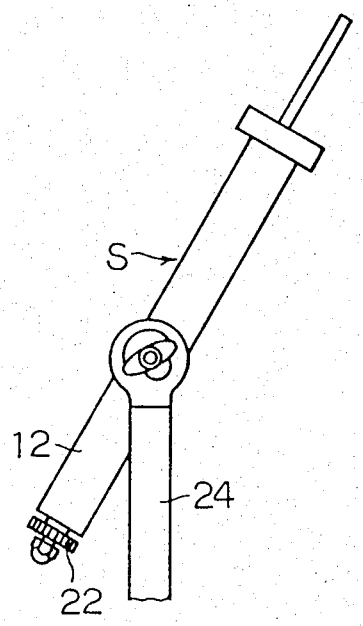
FIG. 4 is a side view, taken at IV—IV in FIG. 3, showing the high-hat stand on the support.

With reference to FIGS. 3 and 4, the external stand pipe or support body 12 is installed on a support 26, which may be a cymbal stand, tom-tom holder, etc., through the connecting support 24 and the positioning clamp 25, which includes a conventional angle adjusting mechanism of the clutch type, as shown in FIGS. 3 and 4, whereby the height and orientation of the closed state high-hat cymbal may be adjusted through the adjustment of the clamp 25 and of the tool 24, and by adjustment of their height along the support shaft 26.

Pressure adjustment between the cymbals 27 and 33 while they are in the closed state is performed by sliding the holding rod 21 a very small distance up and down, through rotation of the adjusting nut 22. This selectively drives the cymbals 27, 33 into contact with each other with greater or lesser pressure, which adjusts the pitch, volume and quality of the sound produced by the cymbals in the closed state. This also adjusts the bias of the spring 20.

Figure 5:
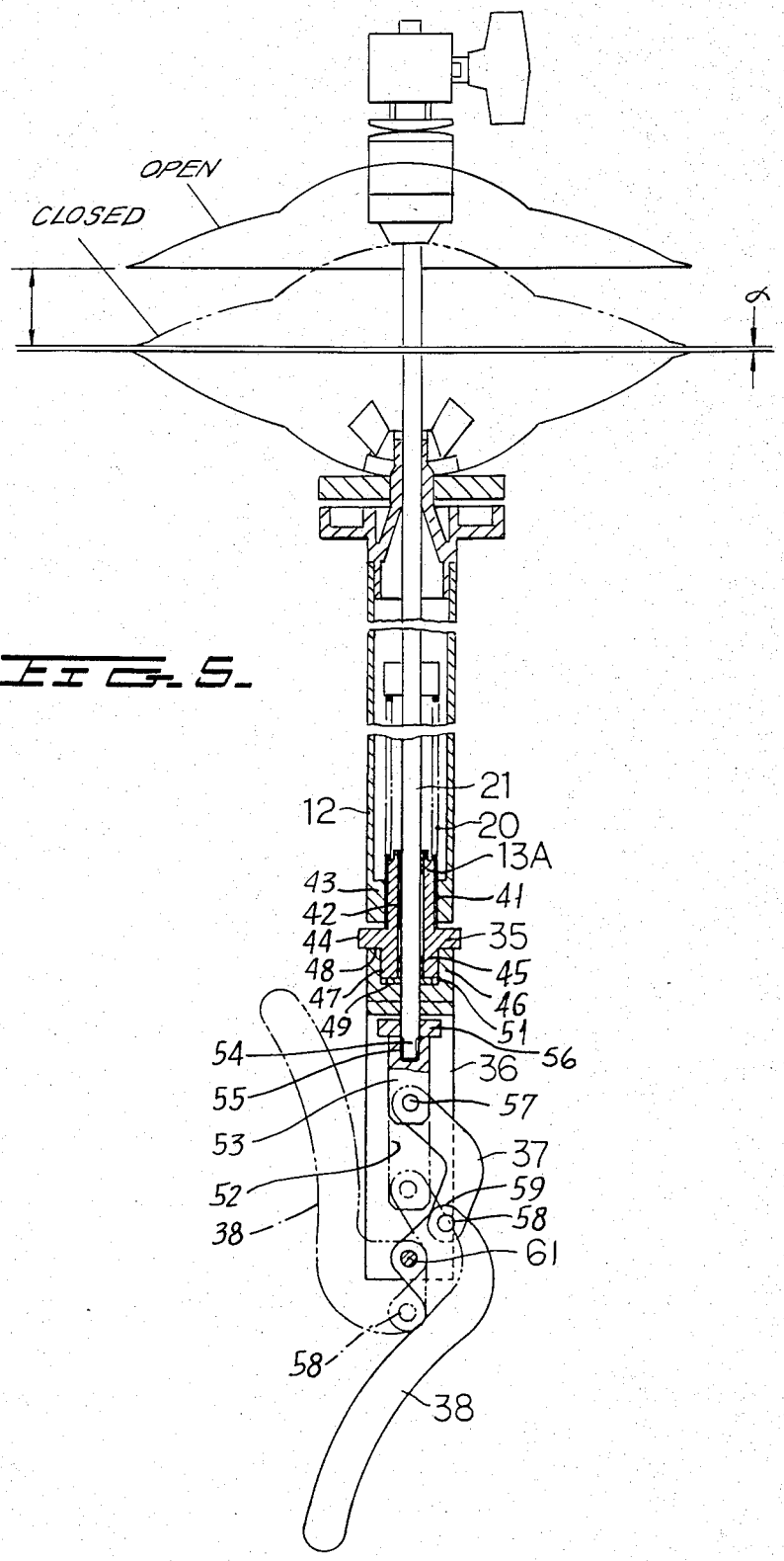
FIG. 5 is a fragmentary cross-sectional view of a high-hat cymbal stand according to a second embodiment of the invention.

In the second embodiment shown in FIG. 5, elements (not shown), particularly relating to the mounting of the top and bottom cymbals and to the spring holding seat are the same as in the first embodiment shown in FIG. 2. The second embodiment has the advantage that it permits the fine adjustments of pressure between the two cymbals which the first embodiment permits, while it also permits a two-step switching by simple operation of a hand lever, or the like, between the closed condition shown in FIG. 2 and an open condition, (FIG. 5), where the top cymbal is raised off the bottom cymbal.

The adjusting nut 22 of the first embodiment has been replaced by the adjusting bolt 35 of the second embodiment, which is located at the bottom of the stand pipe or support body 12 and extends up through the correspondingly threaded opening 41 in the bottom of the stand pipe. The upstanding shank 43 of the bolt 35 above its wide, manually graspable flange 44 is externally screw threaded, and the opening 41 through the bottom of the stand pipe 12 is correspondingly screw threaded to mate with the thread on the shank 43 of the bolt 35. The bolt 35 is hollow and the holding rod 21 extends through the opening 42 through the bolt with smooth passage clearance for enabling the holding rod to shift axially with respect to the bolt 35 (as occurs during change between the open and closed conditions) while motion of the rod is guided by the bolt 35. The top end of the bolt 35 defines the spring receiving seat 13A, which replaces the fixed seat 13 in the embodiment of FIG. 2. Although the seat 13A is movable together with the bolt 35, contrary to the seat 13 which is stationary, this is not significant for the invention. Rotation of the bolt 35 in the opening 41 finely adjusts its position along the stand pipe 12. By means described below, the bolt 35 is connected to shift axially together with the holding rod for fine adjustments of the holding rod 21.

Beneath its flange 44, the bolt 35 has a downwardly depending tubular portion 45, which completes the guide for the rod 21.

There is disposed beneath the bolt 35 a cup-shaped support 46 with an opening 47 in its top 48 shaped to receive the lower portion 45 of the bolt 35. The side walls of the opening 47 in the cup-shaped support 46 are oriented to the desired orientation of the bolt 35. At The bottom 49 of the opening 47, there is a nylon bushing 51. Through the spring 20, that nylon bushing is pushed up against the bolt 35. The depth of the opening 47 in the support and the height of the nylon bushing 51, and the length of the portion 45 of the bolt 35 together are selected so that there is a small clearance space between the underside of the flange 44 and the top 48 of the support 46, so as to not interfere with the rotation of the bolt 35. The support 46 is a separate element from, but is permanently seated against the top side of the bracket 36, and the force of the spring 20 holds the support 46 and bracket 36 in contact. The bracket 36 has an open, vertically elongate guideway 52 defined within it for receiving and for guiding the vertical reciprocating motion of the pivot support block 53.

The lower end 54 of the holding rod 21 is externally screw threaded and is received in the threaded opening 55 at the upper end of the pivot support block 53. This connection between the holding rod 21 and the block 53 performs important functions in connection with fine adjustments in the position of the holding rod while the cymbals are in the closed condition and in connection with the large adjustment between the open and closed condition of the cymbals. Immediately above the pivot support block 53 and affixed to the rod 21 is the cylindrically shaped cushion 56. The cushion 56 also serves two functions. The spring 20 operating upon the seat 19 (seen in FIG. 2) normally pushes the rod 21 upwardly. Through the fixed connection between the rod 21 and the block 53, the cushion 56 is also pushed up. The cushion 56 pushes the support 46 up against the bushing 51 and the lower portion 45 of the bolt. Thus, adjustment of the axial position of the bolt 35 moves the support 46, cushion 56, block 53 and rod 21 for fine adjustments in the cymbal pressure in their closed condition.

The cushion also assures that when the below-described handle 38 is moved to move the pivot support block 53 upwardly, to move the holding rod to move the cymbals to the open condition, the impact between the pivot support block 53 and the underside of the bolt support 46 is cushioned, and this also stops the spring 20 from generating a shrill noise due to the movement of the elements followed by an abrupt halt.

A bent crank member block 37 is connected at pivot 57 to the reciprocating pivot support block 53 at one end of the lever 37. The other end of the lever 37 is connected at pivot 58 to one end 59 of the condition adjustment handle 38. The manually operable handle 38 is additionally connected at pivot 61 to the bracket 36. Because of the offset positions between the pivot 58 of the lever 37 and the pivot 61 of the lever 38, pivoting of the handle 38 moves the lever 37 up and down between the illustrated solid line open state of the cymbals and the illustrated broken line, closed state of the cymbals.

As the block 53 reciprocates up and down in the bracket 36 through operation of the handle 38, the holding rod 21 is correspondingly reciprocated between the downward position, where the cymbals of the high-hat cymbal are in their closed condition, which is shown in FIG. 2, and the position where the rod 21 is upraised, as shown in solid lines in FIG. 5, where the cymbals of the high-hat would be in the open, separated condition. The above provides a description of the movement of the high-hat cymbals between the opened and closed positions.

Accordingly, in both embodiments a high-hat cymbal in the closed condition or state is provided without the need for the high-hat to be stepped in. Furthermore, with the adjustments provided for the high-hat, it becomes possible for the musician to change the closed state pressure of the cymbals of the high-hat during the course of a performance to achieve variations in the high-hat performance, as desired. Finally, with the second embodiment, the musician can easily switch between the open and closed states of the cymbals, and he need not step in the cymbals and when the cymbals are in the closed state.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A high-hat cymbal stand, comprising:

a support body having a top portion and an opposite bottom portion; a bottom cymbal holding first part located at the top portion of the support body for holding a bottom cymbal of the high hat; a lower elastic body receiving seat located toward the bottom portion of the support body;

a holding rod having an upper cymbal holding second part projecting above the bottom cymbal holding first part of the support body for carrying a top cymbal of the high hat; the first part and the second part being placed that a bottom and a top cymbal held to the respective parts are in contact; the holding rod extending down through the support body to the bottom portion of the holding rod;

an upper elastic body holding seat on the holding rod in the support body;

an elastic body extending between the lower elastic body receiving seat and the upper elastic body holding seat, for biasing the holding rod upwardly with respect to the support body, which biases the upper portion of the holding rod up from the first part of the support body, thereby tending to bias the cymbals apart;

holding rod adjustment means for moving the holding rod over small controlled distances with respect to the support body for moving the second part and the first part with respect to each other, thereby for controlling the pressure together of the bottom and top cymbals held respectively to the first part and the second part.

2. The stand of claim 1, wherein the holding rod adjustment means comprises the holding rod having a lower end portion which protrudes below the bottom end of the support body, and that portion of the holding rod is screw threaded; and an adjusting nut screw threadedly receiving the threaded portion of the lower end portion of the holding rod, the nut being held to the support body, such that rotation of the nut with respect to the holding rod slides the holding rod along the support body by a small, controllable amount.

3. The stand of claim 2, wherein the elastic body is located inside the support body, and the holding rod extends through the elastic body.

4. The stand of claim 1, wherein the holding rod protrudes beneath the support body;

top cymbal position adjustment means for moving the holding rod over relatively large distances, for selectively moving the holding rod so as to move the top cymbal held thereon to a closed state with respect to the bottom cymbal held on the top portion of the support body, whereby the cymbals held thereon are in contact, and for selectively moving the holding rod up through the support body a distance to move the second part of the holding rod a distance above the first part of the support body, thereby to separate the top and bottom cymbals to an open state.

5. The stand of claim 4, wherein the holding rod adjustment means comprises an adjusting bolt which is screw threaded on its exterior, and comprises a hole in the bottom of the support body in which the adjusting bolt is screw threadedly received, such that rotation of the bolt moves the bolt up and down in the support body; the holding rod passing freely through the adjusting bolt to protrude beneath the support body to the top cymbal position adjustment means;

the top cymbal position adjustment means comprises a block for holding the protruding holding rod so that the block for the holding rod moves away from the bottom portion of the support body, which moves the holding rod to move the cymbals to their closed state, and the block moves toward the support body, which moves the holding rod to move the cymbals to their open state; the elastic body normally biasing the block toward pressing upward upon the adjusting bolt.

6. The stand of claim 5, further comprising a bracket extending beneath the support body and along which the block for the holding rod is movable.

7. The stand of claim 5, further comprising a handle attached to the block; the handle being selectively movable for moving the block away from the support body and toward the support body.

8. The stand of claim 5, wherein the lower elastic body receiving seat is defined on the adjusting bolt for being raised and lowered along with the adjusting bolt.

9. The stand of claim 4, wherein the holding rod adjustment means comprises an element which is gradually movable up and down with respect to the support body; the holding rod passing freely through the element to protrude beneath the support body to the top cymbal position adjustment means;

the top cymbal position adjustment means comprises a block for holding the protruding holding rod, so that the block for the holding rod moves away from the bottom portion of the support body, which moves the holding rod to move the cymbals to their closed state, and the block moves toward the support body, which moves the holding rod to move the cymbals to their open state; the elastic body normally biasing the block toward pressing upward upon the element.

* * * * *